US010054890B2

(12) United States Patent
Ochi

(10) Patent No.: US 10,054,890 B2
(45) Date of Patent: Aug. 21, 2018

(54) DETECTING UNIT, SHEET FEEDING UNIT, AND IMAGE FORMING APPARATUS COMPRISING THE SAME

(71) Applicant: CANON KABUSHIKI KAISHA, Tokyo (JP)

(72) Inventor: Junichi Ochi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/584,148

(22) Filed: May 2, 2017

(65) Prior Publication Data

US 2017/0322507 A1 Nov. 9, 2017

(30) Foreign Application Priority Data

May 9, 2016 (JP) ..... 2016-093590

(51) Int. Cl.
*G03G 15/00* (2006.01)
*G03G 21/16* (2006.01)

(52) U.S. Cl.
CPC ..... *G03G 15/6511* (2013.01); *G03G 15/6502* (2013.01); *G03G 15/6508* (2013.01); *G03G 21/1695* (2013.01)

(58) Field of Classification Search
CPC ..... G03G 15/6508; G03G 15/6502; G03G 15/6511; G01B 5/24
See application file for complete search history.

(56) References Cited

U.S. PATENT DOCUMENTS 4,449,705 A * 5/1984 Shibuya ..... B65H 3/44 271/164
4,586,813 A * 5/1986 Ide ..... B65H 3/0669 271/256
6,565,079 B1 5/2003 Kakegawa et al.
8,430,393 B2 4/2013 Matsushima et al.
8,727,339 B2 5/2014 Matsushima et al.
2007/0248366 A1* 10/2007 Gettelfinger ..... G03G 15/6511 399/16

(Continued)

FOREIGN PATENT DOCUMENTS

JP H10-329963 A 12/1998
JP 2001-206571 A 7/2001

(Continued)

OTHER PUBLICATIONS

Koji Kawamura et al., U.S. Appl. No. 15/431,844, filed Feb. 14, 2017 Art 2833, Kawamura et al. (Pub No. US 2017/0248171 A1) Pub Date Aug. 31, 2017.

*Primary Examiner* — Rodney Bonnette
(74) *Attorney, Agent, or Firm* — Fitzpatrick, Cella, Harper & Scinto

(57) ABSTRACT

An image forming apparatus includes a main assembly including an image forming portion; a rotatable member capable of feeding a sheet and configured to rotate; and a detecting unit including an interrelating member configured to rotate in interrelation with rotation of the rotatable member, a detecting member configured to detect rotation of the interrelating member, and a holding member configured to integrally hold the interrelating member and the detecting member. The interrelating member, the detecting member and the holding member are integrally assembled into a unit. The detecting unit is detachably mountable to the main assembly.

14 Claims, 9 Drawing Sheets

(56) References Cited

U.S. PATENT DOCUMENTS

| | | | | |
|---|---|---|---|---|
| 2008/0267639 | A1* | 10/2008 | Totsuka ..... | G03G 15/6511 399/23 |
| 2015/0301492 | A1 | 10/2015 | Ochi | |

FOREIGN PATENT DOCUMENTS

| | | | |
|---|---|---|---|
| JP | 2005-289642 | A | 10/2005 |
| WO | 2011/007406 | A1 | 1/2011 |

* cited by examiner (a)

(b)

DETECTING UNIT, SHEET FEEDING UNIT, AND IMAGE FORMING APPARATUS COMPRISING THE SAME

FIELD OF THE INVENTION AND RELATED ART

The present invention relates to an image forming apparatus.

Conventionally, for example, when sheet (paper) feeding control is carried out in a laser beam printer or an ink jet printer of an electrophotographic type, a method of detecting rotation of rollers and gears relating to sheet feeding has been known. Specifically, rotation of a feed roller for feeding a sheet such as paper is detected or rotation of a separating roller for separating and feeding the sheet from a feeding cassette is detected.

Of such image forming apparatuses, an image forming apparatus in which the rotations of the rollers relating to the feeding of the sheets and feeding timing is controlled in order to separate and feed the sheets, one by one, stacked in the feeding cassette has been known.

For example, International Publication No. WO2011/007406 discloses a rotation detecting device for detecting rotation of a retard roller opposing a feed(ing) roller provided downstream of a pick-up roller for picking up a sheet. In WO2011/007406, in order to provide the rotation detecting device coaxial with a member-to-be-measured or on a rotation shaft rotating in interrelation with the rotation detecting device, a unit including a member-to-be-measured as one of constituent elements thereof is provided with the rotation detecting device.

FIG. 12 shows a feeding unit having a conventional constitution. A feeding unit 101 includes a retard roller 102. On a retard roller driving shaft 105 of the retard roller 102, a rotation detecting device, constituted by an encoder wheel 103 and a sensor 104, is provided.

In the case where the rotation detecting device is disposed is a sheet (paper) feeding mechanism of the image forming apparatus, there is a possibility that improper detection occurs due to contamination with paper powder, scattered toner, or the like, so that maintenance by a service person is needed in some instances. The sheet feeding mechanism is provided inside a casing of the apparatus, and in many cases, a constitution in which the sheet feeding mechanism is assembled into a unit as a feeding unit and is detachably mountable to an apparatus main assembly is employed. Accordingly, in order to clean and exchange the rotation detecting device, many parts (components) are required to be demounted, and therefore, operativity is poor.

On the other hand, in the case where, as the rotation detecting device, a lever for permitting light transmission and light blocking of a sensor and an encoder wheel are provided in a feeding unit and a detecting means, such as a sensor or the like, is provided in another unit (apparatus casing or the like), when the feeding unit is mounted and demounted, there is a problem in operativity. This is because in a constitution in which the detecting means sandwiches the lever or the encoder wheel, when the feeding unit is mounted and demounted, the detecting means is required to be demounted from the other unit in advance in order not to be damaged by interference with the lever or the encoder wheel.

Further, in order to improve the operativity even a little, in the case where both of the sensor and the lever or the encoder wheel are provided at an end portion of the feeding unit with respect to an axial direction, a length of the feeding unit with respect to the axial direction increases, so that there is a problem such that a width of an apparatus main assembly becomes large.

SUMMARY OF THE INVENTION

A principal object of the present invention is to provide an image forming apparatus capable of improving operativity regarding maintenance, such as exchange of a detecting unit, while suppressing upsizing of the unit, and by extension, to suppression of upsizing of the apparatus using the unit.

According to an aspect of the present invention, there is provided an image forming apparatus comprising: a main assembly including an image forming portion; a rotatable member capable of feeding a sheet and configured to rotate; and a detecting unit including an interrelating member configured to rotate in interrelation with rotation of the rotatable member, a detecting member configured to detect rotation of the interrelating member, and a holding member configured to integrally hold the interrelating member and the detecting member, wherein the interrelating member, the detecting member and the holding member are integrally assembled into a unit, wherein the detecting unit is detachably mountable to the main assembly.

Further features of the present invention will become apparent from the following description of exemplary embodiments with reference to the attached drawings.

DESCRIPTION OF EMBODIMENTS

Embodiments of the present invention will be specifically described with reference to the drawings. Dimensions, materials, shapes and relative positions of constituent elements described in the following embodiments should be appropriately be changed depending on structures and various conditions of mechanisms to which the present invention is applied, and therefore, the scope of the present invention is not intended to be limited to the following embodiments unless otherwise specified.

Embodiment 1

An image forming apparatus including a rotation detecting device in Embodiment 1 of the present invention will be described using FIGS. 1 to 4. An example of a structure of the image forming apparatus including the rotation detecting device will be described using FIGS. 1 to 3, and then the rotation detecting device will be specifically described using FIG. 4 and subsequent figures.

Figure 1:
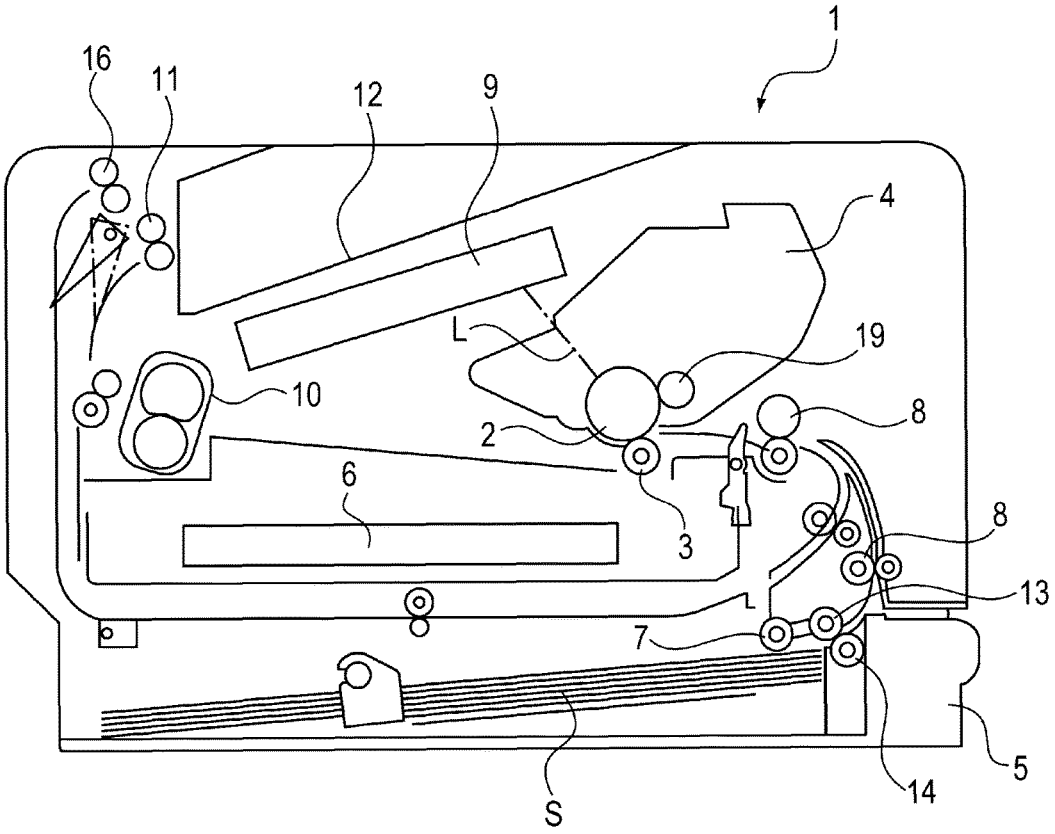
FIG. 1 is a sectional view showing an example of a structure of an image forming apparatus according to Embodiment 1.

FIG. 1 is a sectional view showing the example of the structure of the image forming apparatus including the rotation detecting device in this embodiment. In this embodiment, an image forming apparatus using an electrophotographic image forming process and having a double-side printing function is shown. As shown in FIG. 1, inside the image forming apparatus 1, which is an apparatus main assembly, an image forming portion for forming an image on a sheet is provided. The image forming portion includes a photosensitive drum 2, a transfer roller 3 and the like. In this embodiment, the photosensitive drum 2 is included in a process cartridge 4, and the process cartridge 4 is detachably mounted to the image forming apparatus 1 so that a user can exchange the photosensitive drum 2. Incidentally, the process cartridge 4 includes, as process means actable on the photosensitive drum 2, an unshown charging roller, a developing roller 19, an unshown cleaning device and the like.

In the image forming apparatus 1, a feeding cassette 5 is provided. Sheets, on which an image is to be formed, are stacked in a sheet bundle S in the feeding cassette 5. By a controller 6, rotation of an unshown driving motor is controlled, so that a pick-up roller 7 is rotated and starts feeding an uppermost sheet of the sheet bundle S stacked on the feeding cassette 5. The fed sheet enters a nip between a feed roller 13 and a retard roller 14. A rotational direction of the feed roller 13, as a first rotatable member, is to feed the sheet toward the image forming portion. On the other hand, a driving shaft of the retard roller 14, as a second rotatable member, is rotated to feed the sheet in the opposite direction.

Figure 2:
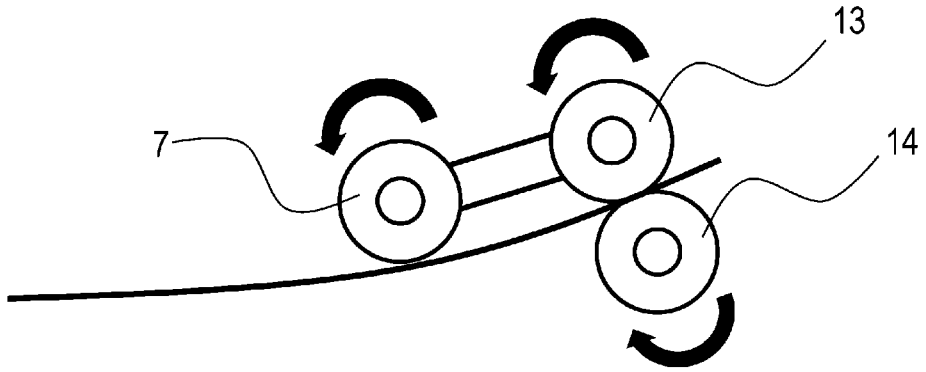
FIG. 2 is a sectional view showing an operation of a retard roller in Embodiment 1.

The driving shaft of the retard roller 14 always rotates in one direction. A torque limiter 28 (shown in FIG. 4) is provided on the driving shaft of the retard roller 14, and therefore, a rotational direction of the retard roller 14 varies depending on a condition of the nip. As shown in FIG. 2, in the case where only one sheet exists in the nip between the feed roller 13 and the retard roller 14, the retard roller 14 is rotated by a frictional force with the sheet. The rotational sense of the driving shaft of the retard roller 14 is the same as that of the feed roller 13 so that the feeding force of the driving shaft of the retard roller 14 is opposite to that of feed roller 13, but the rotation of the retard roller 14 is absorbed by a slip of the torque limiter 28. This is also true for the case where the sheet does not exist in the nip between the feed roller 13 and the retard roller 14.

Figure 3:
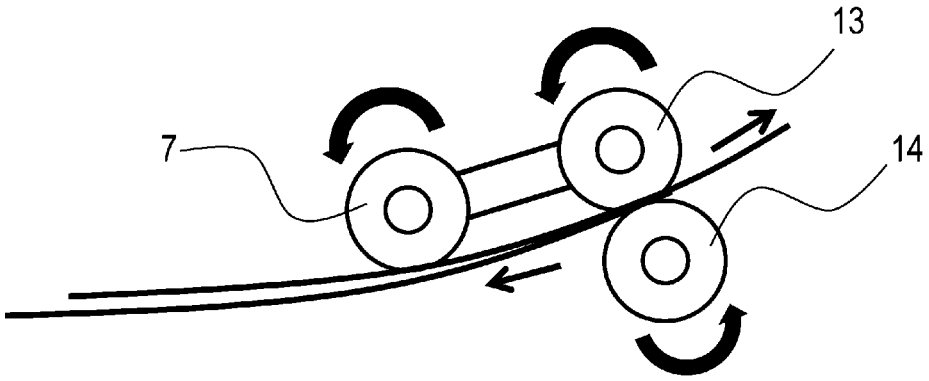
FIG. 3 is a sectional view showing the operation of the retard roller in Embodiment 1.

On the other hand, in the case where a plurality of sheets are fed superposedly, a frictional force between the superposed sheets is relatively low. For that reason, as shown in FIG. 3, the retard roller 14 rotates in a direction in which the sheet is pushed back toward the feeding cassette 5, and the superposed sheet is separated, so that only one sheet is fed by the feed roller 13 opposing the retard roller 14. Thereafter, the sheet is fed in the order of a feeding roller pair 8, the photosensitive drum 2 and the transfer roller 3. Incidentally, after the sheet is nipped between the feeding between pair 8, by disconnecting an unshown electromagnetic clutch, drive of the pick-up roller 7, the feed roller 13 and the retard roller 14 is eliminated.

A laser scanner 9 for writing an image emits laser light L, so that an electrostatic latent image is formed on the surface of the photosensitive drum 2 electrically charged by the charging roller. Then, the electrostatic latent image on the photosensitive drum 2 is developed with toner supplied by the developing roller 19, so that a toner image is formed on the photosensitive drum 2. The toner image is transferred onto a first surface of the sheet between the photosensitive drum 2 and the transfer roller 3. Thereafter, the sheet is heat-fixed by a fixing device 10 and is fed toward a discharge tray 12 by a discharging roller pair 11.

Next, a structure of the rotation detecting device (rotation detecting means) as a feature of this embodiment will be described specifically with reference to FIGS. 4 and 5.

Figure 4:
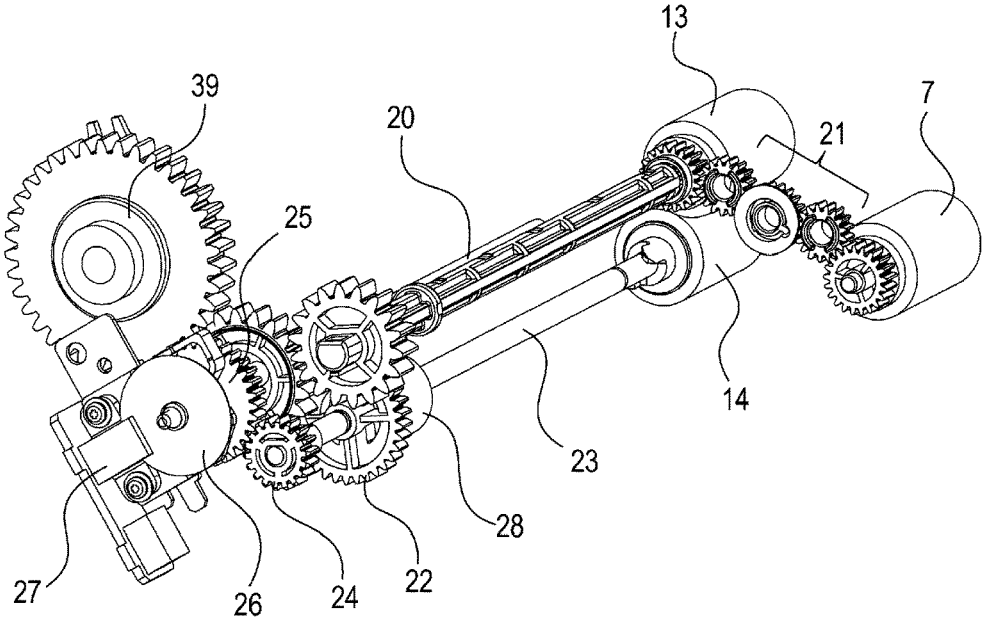
FIG. 4 is a perspective view showing a structure of a rotation detecting device in Embodiment 1.

FIG. 4 is a perspective view showing a structure from the pick-up roller 7, the feed roller 13 and the retard roller 14 to the rotation detecting device. In the case where a feeding operation is carried out, an electromagnetic clutch 39 is connected, so that a driving force transmitted from an unshown driving source is transmitted to the feed roller 13 through a feed roller driving shaft 20 via a gear train, and thus the feed roller 13 is driven. The driving force is transmitted from the feed roller 13 to the pick-up roller 7 through a gear train 21. The driving force is branched by the gear train and is transmitted to the retard roller 14 through the torque limiter 28 from a retard roller driving gear 22 which is on a first shaft, and thus the retard roller 14 is driven. The retard roller driving gear 22 always rotates at a certain speed, but in the case where a torque exceeds a set torque of the torque limiter 28, the retard roller driving shaft 23 and the retard roller 14 fluctuate in rotational speed.

A first sensor gear 24 has a function of rotating a second sensor gear 25 and an encoder wheel 26. The second sensor gear 25 (second gear) engages with the first sensor gear 24 rotating integrally with rotation of the retard roller 14 and rotates. The encoder wheel 26 is bonded to the second sensor gear 25 and integrally rotates with the second sensor gear 25.

The first sensor gear 24 is provided on the retard roller driving shaft 23, and therefore rotation transmitted to the second sensor gear 25 is rotation of the retard roller 14. The encoder wheel 26 is an interrelating member rotating in interrelation with the rotation of the retard roller 14 via the first sensor gear 24 and the second sensor gear 25. The first sensor gear 24 is a first gear rotating integrally with the rotation shaft 23 of the retard roller 14. In this embodiment, a constitution in which the first sensor gear 24 and the second sensor gear 25 are interposed between the retard roller 14 and the encoder wheel 26 is described, but the present invention is not limited to this constitution. For example, a constitution such that the first sensor gear 24 and the second sensor gear 25 do not exist and the encoder wheel 26 is directly fitted around the retard roller driving shaft 23 and thus the retard roller 14 and the encoder wheel 26 rotate in a 1:1 relationship may also be employed.

A constitution of a rotary encoder as the rotation detecting device in this embodiment is, for example, comprised of the encoder wheel prepared by printing slits in a thin disk of a transparent resin material with regular intervals and optical sensor 27 as a detecting member provided so as to sandwich a flat surface of the encoder wheel 26. The sensor 27 optically detects transmission and blocking of light by rotation of the encoder wheel 26. The sensor 27 detects the rotation of the encoder wheel 26. The sensor 27 outputs a signal to a controller 6 at timing of a transparent portion (light transmission) and a printed portion (light blocking), and the controller 6 calculates a rotational speed of a member-to-be-measured (the retard roller 14 in this embodiment). Incidentally, there is also an encoder wheel 26 of a type in which an opaque member is provided with a slit (opening).

As described above, in this embodiment, the constitution in which the first sensor gear 24 and the second sensor gear 25 are interposed between the retard roller 14 and the encoder wheel 26 is employed in this embodiment. In such a constitution, by changing a gear ratio between the first sensor gear 24 and the second sensor gear 25, the rotational speed of the encoder wheel 26 can be increased or reduced relative to the retard roller 14. As one of advantages of the above-described constitution, it is possible to obtain a rotation detecting means which is broad in width of the slit (opening) and which is advantageous for deposition of a foreign matter without lowering detection accuracy by increasing the rotational speed while broadening the width of the slit provided in the encoder wheel 26. Further, as another advantage, a rotation center of the encoder wheel 26 can be disposed so as to be offset relative to the retard roller driving shaft 23 correspondingly to a gap between the shafts of the first sensor gear 24 and the second sensor gear 25, and therefore, an arrangement of the rotation detecting means can be designed with a latitude to some extent.

By the constitution as described above, the rotational speed of the retard roller 14 is detected. By a numerical value of a fluctuation in detected rotational speed of the retard roller 14, the controller 6 discriminates that a leading end of a subsequent sheet reached a nip between the feed roller 13 and the retard roller 14, and controls timing when an electromagnetic clutch 39 eliminates drive of the feed roller 13, the pick-up roller 7 and the retard roller 14.

Figure 5:
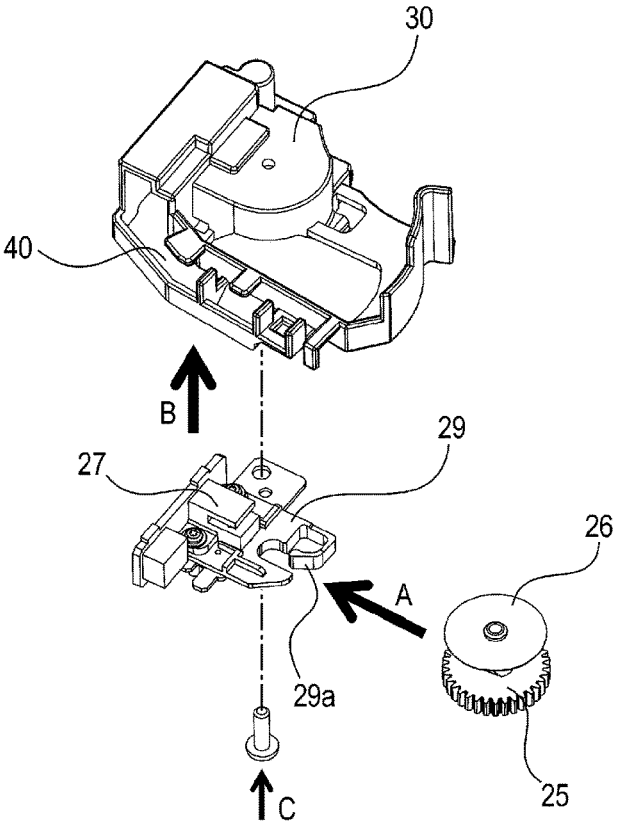
FIG. 5 is a perspective view showing an assembling procedure of an encoder unit in Embodiment 1.
Figure 6:
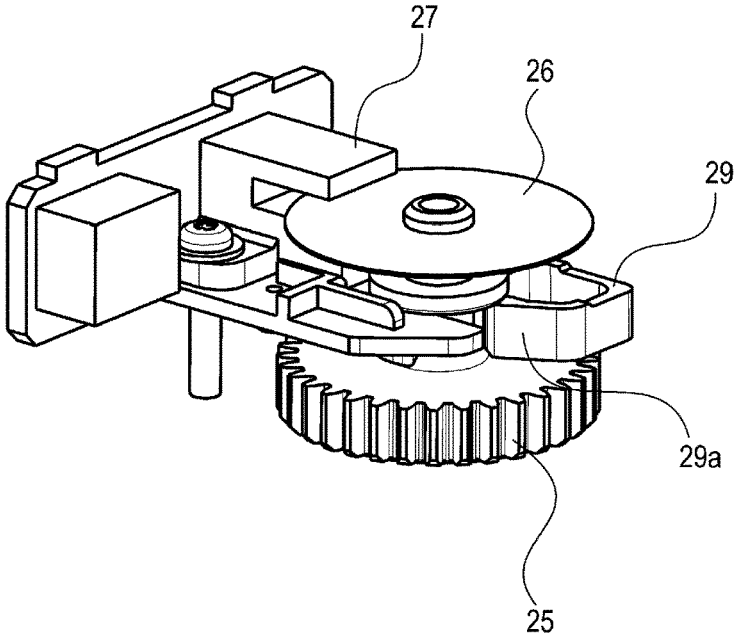
FIG. 6 is a perspective view showing an assembled state of the rotation detecting device in Embodiment 1.

FIG. 5 shows a structure of the rotation detecting device. As described above, the second sensor gear 25, to which the encoder wheel 26 is bonded, is mounted in a resin-made holder member 29, to which the sensor 27 is fixed, as shown by an arrow A. That is, the encoder wheel 26 is provided integrally with the second sensor gear 25 and is mounted into the sensor 27 by being slid in a direction parallel to a flat surface of the encoder wheel 26. Thus the flat surface of the encoder wheel 26 is disposed by being sandwiched by the sensor 27. This state is shown in FIG. 6.

The holder member 29, to which the sensor 27 is fixed, includes an arm portion 29*a* as a gear holding portion for holding the second sensor gear 25. During the mounting of the second sensor gear 25 into the holder member 29, the arm portion 29*a* is flexed, and after the mounting, the arm portion 29*a* is caught by the second sensor gear 25, so that the second sensor gear 25 is prevented from being disconnected from the holder member 29. Then, the holder member 29, to which the sensor 27 is fixed and in which the second sensor gear 25 is mounted, is fixed to a cover member 30 as shown by an arrow B in FIG. 5. The sensor 27, the encoder wheel 26 and the second sensor gear 25 can be integrally mounted in the cover member 30 by using the holder member 29, and therefore, operativity is good. Finally, the holder member 29 and the cover member 30 are fixed with a screw shown by an arrow C.

The cover member 30 has a function as a holding member (holder) for holding the rotation detecting device and, simultaneously, also has a function as a cover for preventing or alleviating entrance of dust and dirt, causing erroneous detection, into a detecting portion. Further, the sensor 27 is an optical sensor, and in order to prevent erroneous detection due to stray light coming from an outside, the cover member 30 may preferably be molded from a black resin material. Further, in the cover member 30, a wiring guide 40 for holding a wiring lead connected with the sensor 27 is formed by molding.

Figure 7:
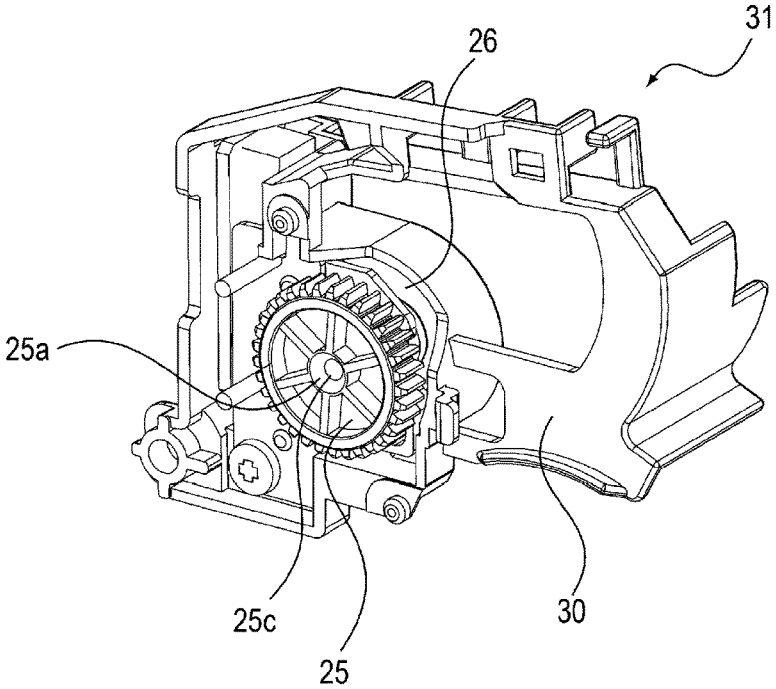
FIG. 7 is a perspective view showing an assembled state of the encoder unit in Embodiment 1.

As described above, the encoder wheel 26, the second sensor gear 25 and the sensor 27 are integrally assembled with the cover member 30 into a unit as encoder unit 31 which is shown in FIG. 7. FIG. 7 is a perspective view of the encoder unit 31 as seen from an inside of the cover member 30. The encoder unit 31 is a detecting unit for integrally holding the encoder wheel 26 and the sensor 27 by the cover member 30.

Figure 10:
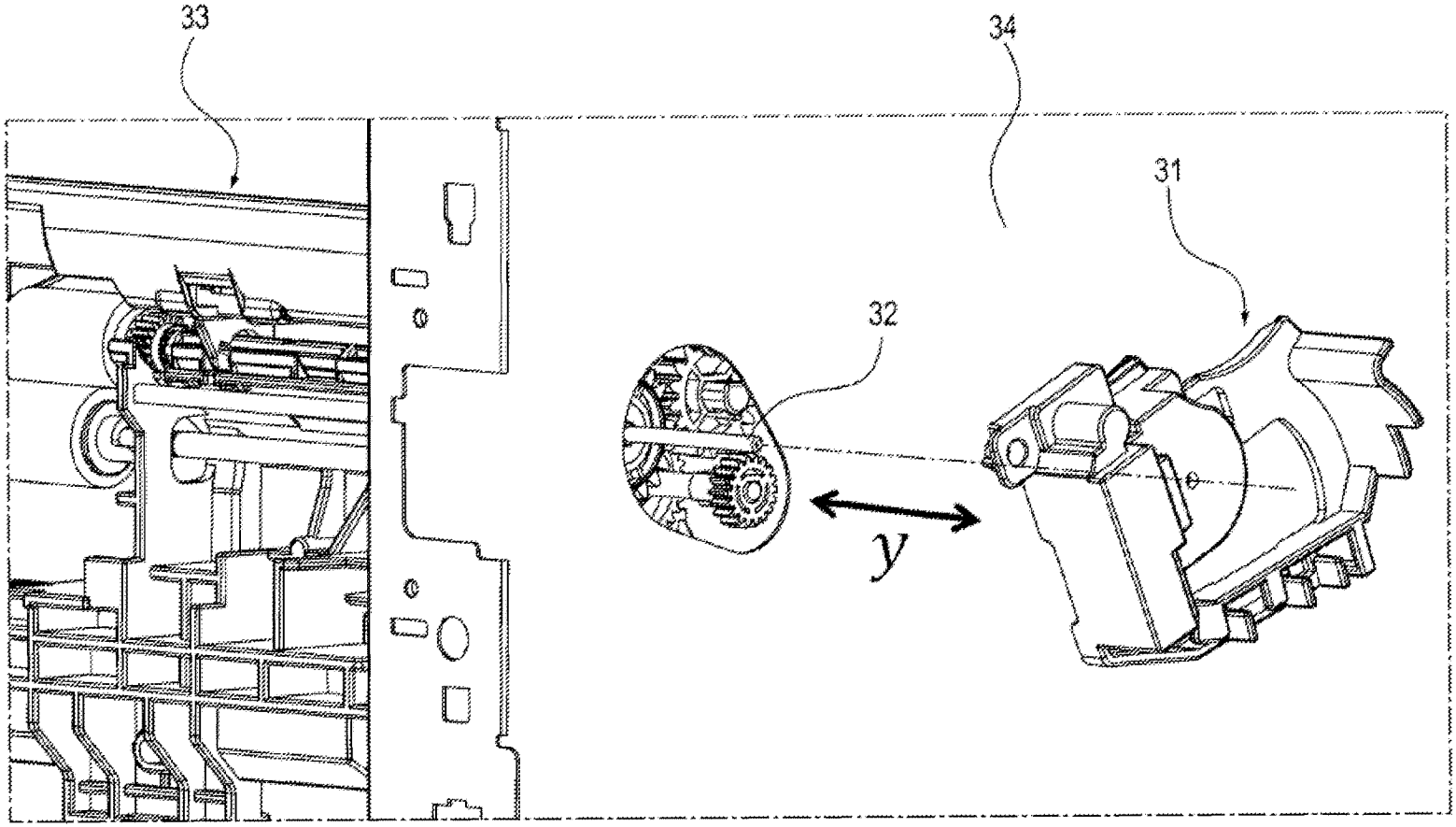
FIG. 10 is a perspective view showing mounting of the encoder unit to an apparatus main assembly.

An end surface of a center hole 25*c* of the second sensor gear 25 has a tapered portion 25*a*. For that reason, when the encoder unit 31 is mounted to the apparatus main assembly of the image forming apparatus 1, a shaft 32 (second shaft) (FIG. 10) projecting from the apparatus main assembly side easily enters the center hole 25*c* of the second sensor gear 25. The shaft 32 which is a rotation shaft of the second sensor gear 25 is provided as a part of the apparatus main assembly or the feeding unit mounted in the apparatus main assembly. This is because when the shaft 32 is provided as a part of a member which is the same member as a member for holding an object (member-to-be-measured, rotatable member) for which rotation is to be generated, an axis interval between the gears can be ensured with high accuracy.

Figure 8:
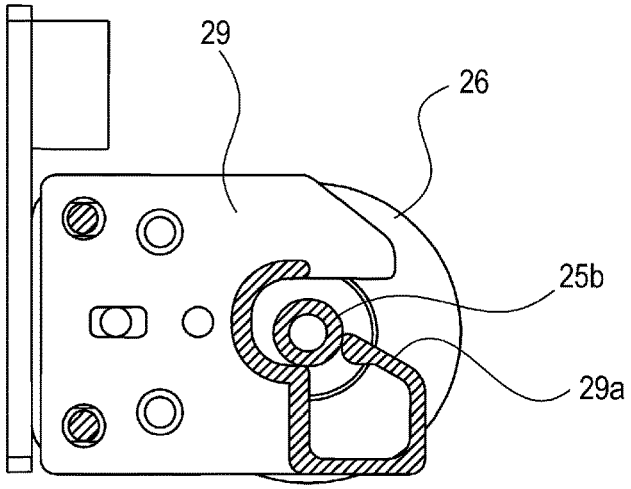
In FIG. 8, (a) and (b) are sectional views each showing a holding state of a second gear in Embodiment 1.
Figure 8:
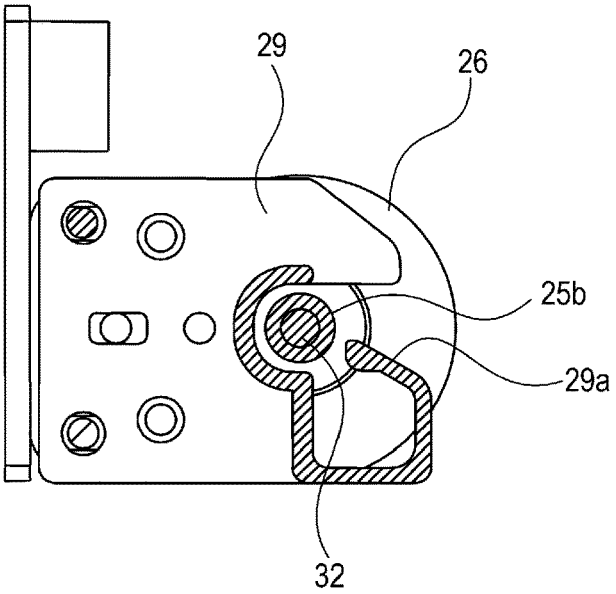

Here, the function of the holder member 29 will be described. In FIG. 8, (a) and (b) are sectional views for illustrating a portion holding the second sensor gear 25 and are the sectional views in which the portion cut along an axial portion of the second sensor gear 25 is seen from below of the structure in the state shown in FIG. 6. In a state before the encoder unit 31 is mounted to the apparatus main assembly, as shown in (a) of FIG. 8, the holder member 29 holds a rotation center portion 25*b* of the second sensor gear 25 so as not to be disconnected (demounted). On the other hand, in a state in which the encoder unit 31 is mounted to the apparatus main assembly, as shown in (b) of FIG. 8, the rotation center hole 25*c* of the second sensor gear 25 is held by the shaft 32 (FIG. 10) extending from the feeding unit, so that a rotation center is fixed. As a result, in the state of (b) of FIG. 8, the rotation center portion 25*b* of the second sensor gear 25 is held by the holder member 29 with a gap with respect to a radial direction. For this reason, the rotation center portion 25*b* of the second sensor gear 25 does not interfere with the holder member 29 and does not constitute a load during the rotation, so that it is possible to obtain an accurate detection result.

By employing the constitution described above, even in the case where the encoder unit 31 is positioned and fixed to the apparatus main assembly, only the second sensor gear 5 is positioned with respect to the shaft 32 of the feeding unit as a rotation center thereof. Accordingly, a positional relationship between the shaft 32 and the encoder unit 31 relative to the apparatus main assembly is not influenced even when is minutely deviated.

Figure 9:
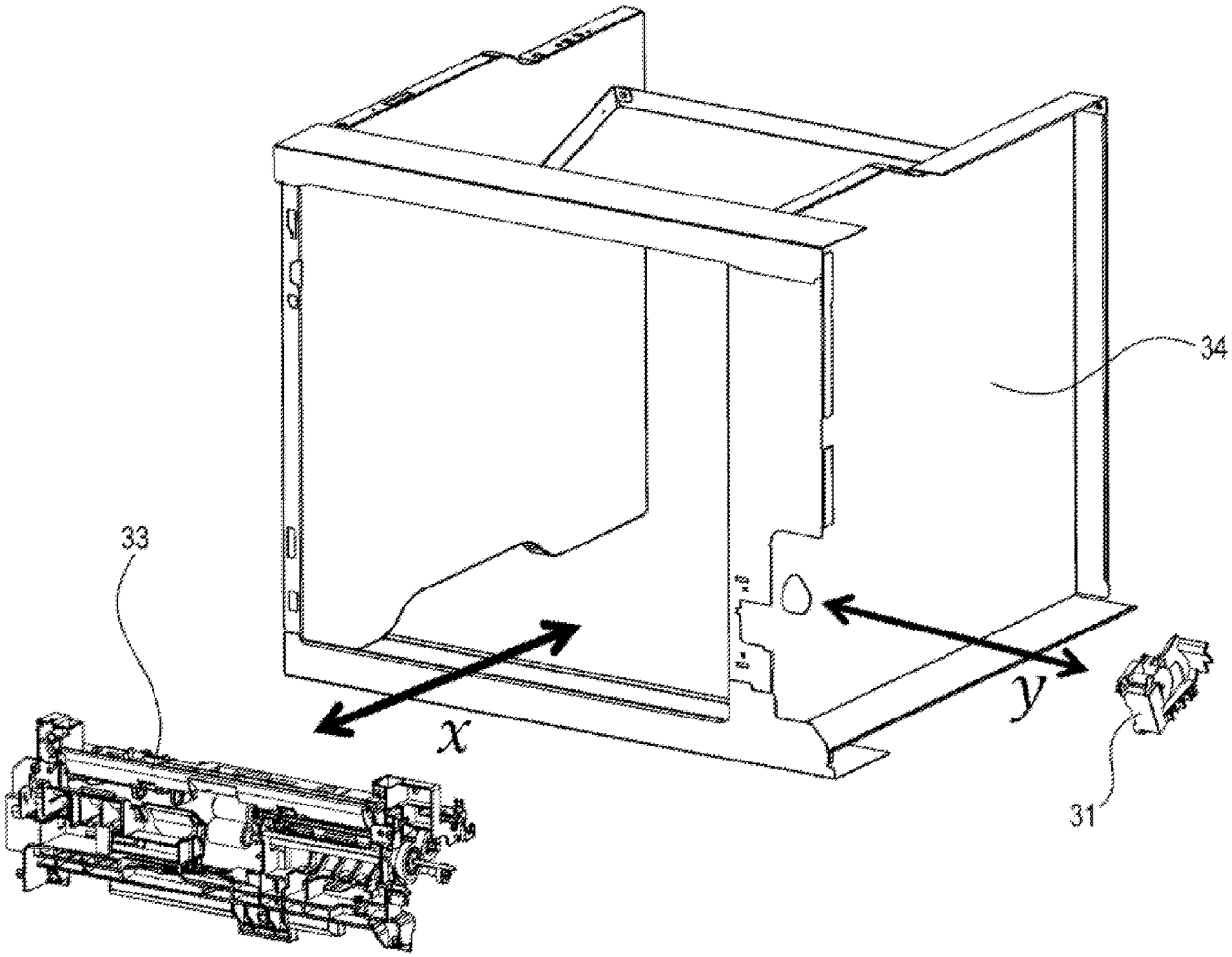
FIG. 9 is a perspective view showing mounting and demounting of a feeding unit and the encoder unit relative to an apparatus main assembly in Embodiment 1.

Next, a mounting method of the encoder unit 31 will be described. In this embodiment, a constitution as shown in FIG. 9 is employed. A feeding unit 33 (conveying unit) is prepared by integrally assembling a sheet feeding mechanism including the pick-up roller 7, the feed roller 13 and the retard roller 14 into a unit. This feeding unit 33 as the conveying unit is detachably mountable to an apparatus main assembly frame 34 with respect to an arrow X direction. On the other hand, the encoder unit 31 is detachably mountable to the apparatus main assembly frame 34 with respect to an arrow Y direction. A mounting and demounting direction of the encoder unit 31 relative to the apparatus main assembly frame 34 is a roller axis direction (axial direction of the shaft 32) of the feeding unit 33 and is the arrow Y direction perpendicular to the arrow X direction which is a mounting and demounting direction of the feeding unit 33 relative to the apparatus main assembly frame 34. By mounting the encoder unit 31 along this direction, the shaft 32 can constitute the rotation center of the second sensor gear 25 and the encoder wheel 26. The order of the mounting is such that first, the feeding unit 33 is mounted to the apparatus main assembly frame 34 and then the encoder unit 31 is mounted to the apparatus main assembly frame 34. In the case of demounting these units, the order is the reverse of the mounting order.

A feature of this embodiment is that parts around the encoder are not mounted to the feeding unit 33, but are assembled into a unit detachably mountable to the apparatus main assembly. In the neighborhood of the sheet feeding and conveying portion, paper powder generate and are deposited on a detecting portion of the encoder and cause an erroneous operation in some instances. Further, there is also a possibility that a contamination of scattered toner causes a similar inconvenience. As regards this problem, in this embodiment, the cover member for the detecting portion of the encoder has a function of alleviating the deposition of the contaminant. On the other hand, it is difficult to completely prevent the contamination with minute powder dust or dirt or the like, and it would be still considered that there is a need to clean or exchange the parts around the encoder. An advantage of the constitution in this embodiment is such that from a mounted state shown in FIG. 10, the encoder unit 31 can be singly demounted from and mounted to the apparatus main assembly frame 34 along the arrow direction without demounting the feeding unit 33. Further, as regards also a device structure, latitude in layout is enhanced, and therefore leads to downsizing of the apparatus.

Embodiment 2

Next, an image forming apparatus including a rotation detecting device according to Embodiment 2 will be described. Incidentally, a constitution and an image forming operation of the image forming apparatus in this embodiment are the same as those described in Embodiment 1. As regards the constitution and an effect which are the same as those in Embodiment 1, constituent elements are represented by the same reference numerals or symbols and will be omitted appropriately from description.

Figure 11:
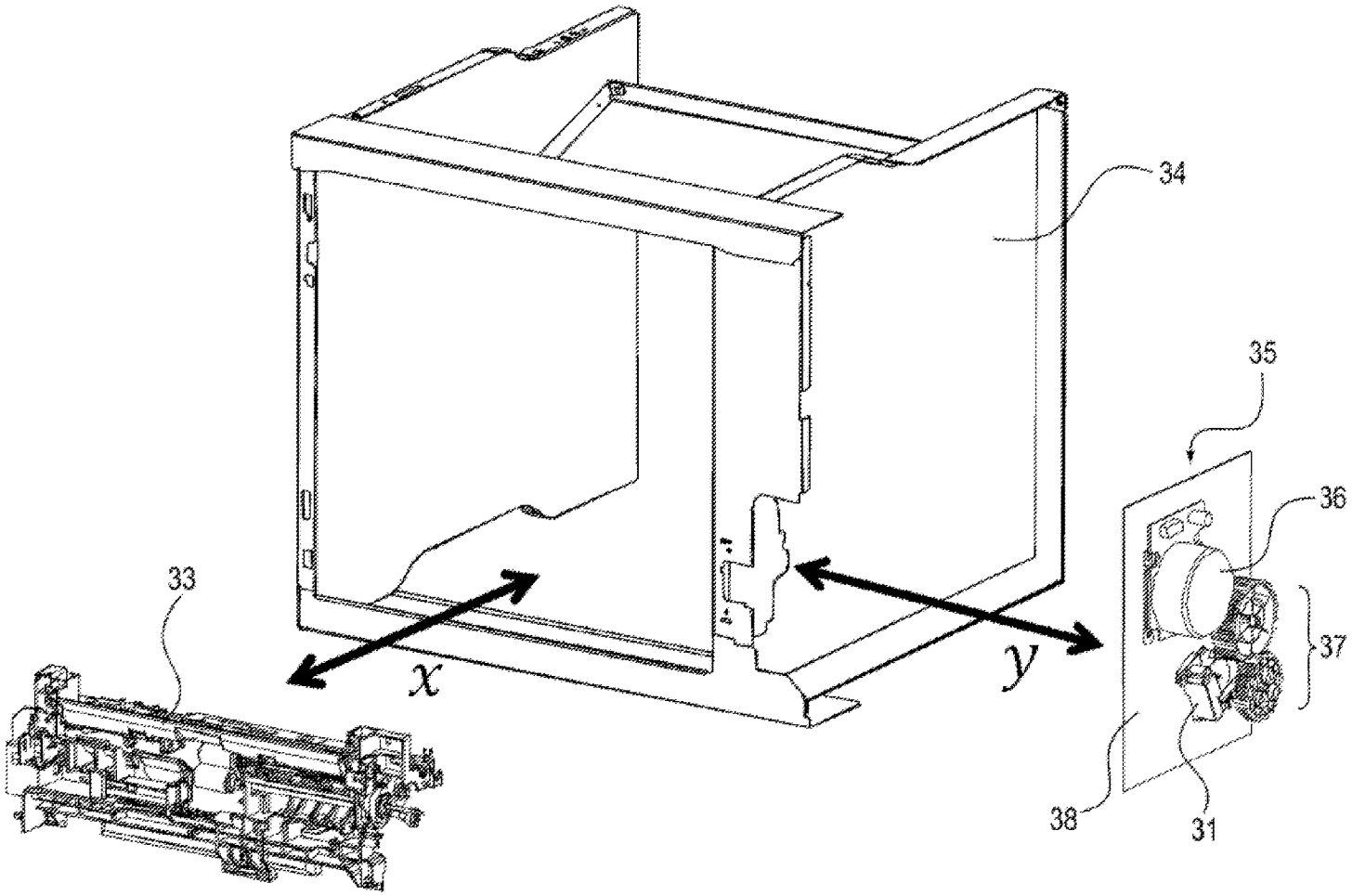
FIG. 11 is a perspective view showing mounting and demounting of the feeding unit and a driving unit relative to the apparatus main assembly in Embodiment 1.
Figure 12:
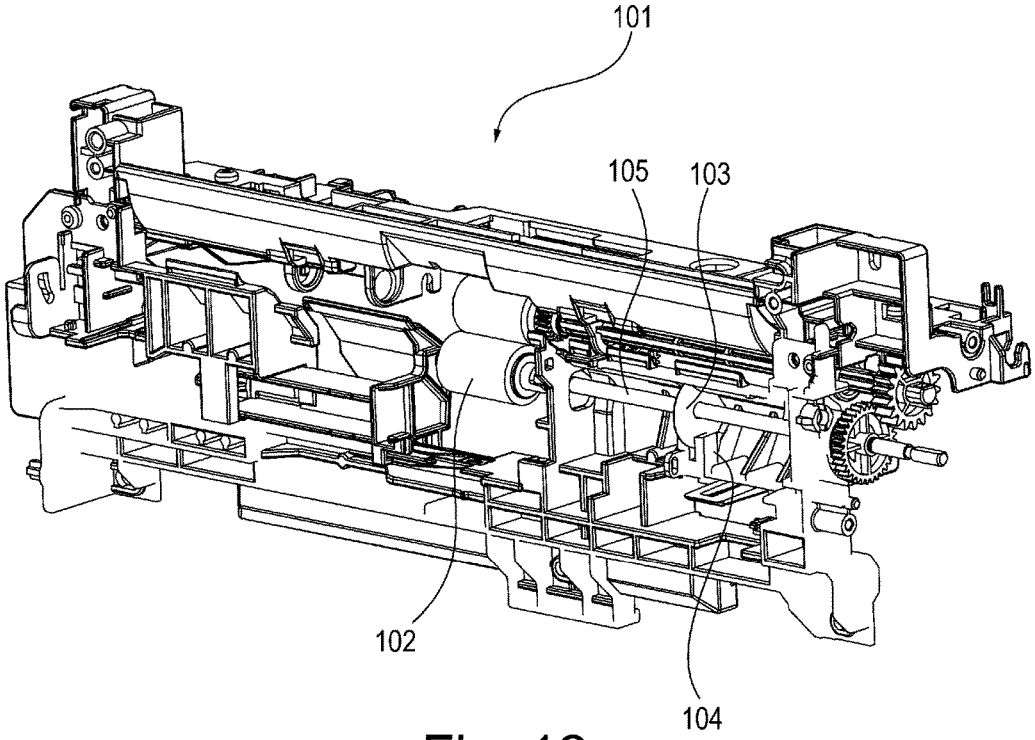
FIG. 12 is a perspective view showing a conventional constitution.

In this embodiment, as shown in FIG. 11, a driving portion such as gears for operating the image forming apparatus is concentrated and constituted as a driving unit 35 detachably mountable to the apparatus main assembly. The driving unit 35 is constituted by a motor 36, a gear train 37, an encoder unit 31, a driving unit frame 38 and the like. Here, the encoder unit 31 is fixed to the driving unit frame 38 so as to be detachably mountable to the driving unit frame 38. The encoder unit 31 is integrally assembled with the driving unit 35 so as to be detachably mountable to the apparatus main assembly frame 34.

A feature of this embodiment is such that the encoder unit 31 and the driving unit 35 are integrally assembled into a unit detachably mountable to the apparatus main assembly.

By employing the above-described constitution, for example, in the case where the encoder unit 31 and the driving unit 35 are mounted to a perpendicular surface as shown in FIG. 11, the encoder unit 31 is mounted to the driving unit 35 in advance, an assembling property during assembling of these units can be simplified. Further, it becomes also possible to improve positional accuracy of the encoder unit 31 relative to the driving unit 35. On the other hand, it is also possible to mount only the encoder unit 31 while putting the driving unit 35 in the mounted state to the apparatus main assembly, and therefore, whether the driving unit 35 is mounted and demounted or the encoder unit 31 is mounted and demounted is selectable depending on a situation, so that operativity is improved.

Other Embodiments

In the above-described embodiments, the rotation detecting device for use with the image forming apparatus was described as an example, but the present invention is not limited thereto. A similar effect can be obtained even when the present invention is applied to a rotation detecting device for use with a sheet feeding device (apparatus) including a rotatable member such as roller for feeding the sheet. As the sheet feeding device, not only a sheet feeding device for feeding a sheet, to be subjected to recording, such as recording paper, but also a sheet feeding device for feeding a sheet, to be read, such as an original may be used. Even when the rotation detecting device is applied to these sheet feeding devices, a similar effect can be achieved.

Further, in the above-described embodiments, as the image forming apparatus, the printer was described as an example, but the present invention is not limited thereto. For example, the image forming apparatus may also be other image forming apparatuses, such as a copying machine, a facsimile machine and a multi-function machine having a combination of functions of these machines. The present invention is applied to the rotation detecting device for use with these image forming apparatuses, whereby it is possible to obtain a similar effect.

According to the present invention, it is possible to improve operativity of exchange of the encoder wheel and the detecting means while suppressing upsizing of the image forming apparatus and to realize downsizing of the image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-093590 filed on May 9, 2016, which is hereby incorporated by reference herein in its entirety.

What is claimed is:

1. An image forming apparatus comprising:

a main assembly including an image forming portion;

a rotatable member capable of feeding a sheet and configured to rotate; and a detecting unit including an interrelating member configured to rotate in interrelation with rotation of said rotatable member, a detecting member configured to detect rotation of said interrelating member, and a holding member configured to integrally hold said interrelating member and said detecting member, wherein said interrelating member, said detecting member and said holding member are integrally assembled into a unit, wherein said detecting unit is detachably mountable to said main assembly.

2. An image forming apparatus according to claim 1, wherein said main assembly includes a first gear configured to rotate integrally with said rotatable member, and said detecting unit includes a second gear engageable with said first gear, wherein said second gear engages with said first gear in a state in which said detecting unit is mounted to said main assembly, and wherein said second gear is spaced from said first gear in a state in which said detecting unit is demounted from said main assembly.

3. An image forming apparatus according to claim 2, wherein said rotatable member has a roller including a first shaft, and wherein said first gear is held by said first shaft.

4. An image forming apparatus according to claim 3, further comprising a first feed roller configured to feed the sheet to said image forming portion.

5. An image forming apparatus according to claim 4, wherein said roller is rotated by following the rotation of said first feed roller.

6. An image forming apparatus according to claim 4, wherein said rotatable member includes a torque limiter configured to vary a rotational direction of said rotatable member between a case where said rotatable member is rotated by following the rotation of said first feed roller and a case where said rotatable member is rotated in the opposite direction of the rotational direction depending on a torque applied to said torque limiter.

7. An image forming apparatus according to claim 3, wherein said second gear and said interrelating member are shaft supported by a second shaft provided in said main assembly and are integrally rotated.

8. An image forming apparatus according to claim 7, wherein a mounting and demounting direction of said detecting unit is an axial direction of said second shaft.

9. An image forming apparatus according to claim 7, wherein a gear ratio between said second gear and said first gear is configured to change the rotational speed of the second gear relative to the first gear.

10. An image forming apparatus according to claim 9, wherein a rotation center portion of said second gear is held by said holding member while leaving a gap with respect to a radial direction.

11. An image forming apparatus according to claim 10, wherein said interrelating member is integrally provided with said second gear, and is configured to be mounted to said detecting unit by being slid in a direction parallel to a flat surface of said interrelating member.

12. An image forming apparatus according to claim 1, wherein said holding member is a cover member configured to cover said interrelating member and said detecting member.

13. An image forming apparatus according to claim 12, wherein said holding member is molded with a black resin material.

14. An image forming apparatus according to claim 13, wherein said holding member is integrally molded with a wiring guide configured to hold wiring connected with said detecting member.

* * * * *